United States Patent [19]

Bierkamp et al.

[11] Patent Number: 4,683,942

[45] Date of Patent: Aug. 4, 1987

[54] ASSEMBLY FOR RETROFITTING TWO AIR HANDLING UNITS TO AN INSTALLATION ORIGINALLY MEANT FOR A SINGLE UNIT

[75] Inventors: James A. Bierkamp, La Crosse; Scott D. Hall, Onalaska; Wade W. Smith, La Crosse, all of Wis.

[73] Assignee: American Standard Inc., New York, N.Y.

[21] Appl. No.: 912,282

[22] Filed: Sep. 29, 1986

[51] Int. Cl.[4] ..... F24D 9/00

[52] U.S. Cl. ..... 165/53; 62/259.1; 62/DIG. 16; 248/237

[58] Field of Search ..... 62/259.1, DIG. 16; 165/48 R, 53; 137/606; 248/237, 678

[56] References Cited

U.S. PATENT DOCUMENTS

| | | | |
|---|---|---|---|
| D. 245,098 | 7/1977 | Kay | 62/DIG. 16 |
| 2,180,634 | 11/1939 | Hubacker | 165/48.1 X |
| 2,886,955 | 5/1959 | Bauman | 165/48.1 X |
| 2,976,884 | 3/1961 | Kurth et al. | 137/606 |
| 3,949,808 | 4/1976 | Gilles | 165/48.1 X |
| 4,016,729 | 4/1977 | Cherry | 62/259.1 |
| 4,018,266 | 4/1977 | Kay | 165/48.1 X |
| 4,315,415 | 2/1982 | Wilson | 62/DIG. 16 |
| 4,403,481 | 9/1983 | Yoho, Sr. | 62/DIG. 16 |
| 4,501,193 | 2/1985 | Trigourea | 98/33.1 |

*Primary Examiner*—William E. Tapolcai

*Attorney, Agent, or Firm*—William J. Beres; Robert J. Harter; Carl M. Lewis

[57] ABSTRACT

A retrofit assembly for adapting two replacement rooftop air handling units to a multizone installation that originally had only one air handling unit. The two replacement units include one heating unit and one cooling unit, while the original unit typically had provided both heating and cooling to several zones in the building. The retrofit assembly includes a valve manifold and a curb adaptor that make it possible to use the building's existing roof curb and air ducts. The curb adaptor supports the cooling unit on top of the existing roof curb and includes an air duct for conveying air from the existing return air ducts in the building to the inlet of the cooling unit. The heating unit is mounted on its own separate roof curb and the valve manifold receives the air discharged from both replacement units and directs it into the existing plurality of supply air ducts which further convey the air to the plurality of zones in the building. The amount of heated or cooled air delivered to each zone is regulated by a plurality of valves that are located in the manifold and which are controlled by thermostats disposed in the zones.

30 Claims, 7 Drawing Figures

ASSEMBLY FOR RETROFITTING TWO AIR HANDLING UNITS TO AN INSTALLATION ORIGINALLY MEANT FOR A SINGLE UNIT

TECHNICAL FIELD

This invention generally pertains to the installation of multizone rooftop air handling units and specifically to an assembly for retrofitting two separate rooftop air handling units to an existing roof curb and air ducts originally associated with a single multizone rooftop unit.

BACKGROUND OF THE INVENTION

A combination heating/cooling unit for temperature conditioning multiple zones in a building is often referred to in the industry as a multizone rooftop unit. Multizone units generally mount atop a building roof curb and include a filter, a constant speed blower, a cooling coil connected in series with a heating coil, and a plurality of independently and thermostatically controlled dampers which regulate the flow of conditioned air supplied to the multiple zones in the building. The heating coil, referred to hereinbelow, includes any type of heat exchanger meant for heating, such as an electric heating coil, steam coil, refrigerant heating coil, or a gas fired heat exchanger.

Air from the temperature conditioned zones is conveyed to the rooftop multizone unit through a return air duct. The blower draws air through both the filter and cooling coil and then discharges one portion of the air through the heating coil and discharges the remaining portion in bypass flow past the heating coil. The flow of temperature conditioned discharged air is regulated by the plurality of dampers in response to the dampers' corresponding zone temperature thermostats. The regulated air is conveyed through multiple suppy air ducts leading to the plurality of zones.

Although combination heating/cooling multizone units provide a unitized package, they have become outdated and expensive to operate due to their inherent inefficiency. The heating coils often require the blower to operate at a relatively constant speed regardless of the heating demand. If the speed were decreased to save electrical energy during low heating demand periods, the reduction of air flow might cause damaging hot spots to develop on the heating coil. In addition, the cooling coil, installed upstream of the heating coil, applies an additional load to the heating coil which leads to even greater inefficiency.

A more efficient method of temperature conditioning a multiple zone building is to use separate units, with one dedicated to heating and the other to cooling. With two separate units, the heating unit can be an efficient variable air volume type. The heating coil can be specifically designed to match an appropriate variable speed blower and can also function without the burden of an upstream cooling coil. The cooling unit can also be a variable air volume type having either variable position inlet guide vanes, discharge dampers, or a variable speed blower for modulating the air flow in response to the cooling demand. Two variable air volume units reduce the amount of energy required to distribute air throughout the system.

Retrofitting two units to existing air ducts originally installed for a single multizone unit can be complicated. U.S. Pat. No. 4,501,193 illustrates how two similar cooling units can be mounted on top of a single newly installed roof curb, provided with internal ductwork for two units. However, the patent offers no suggestion as to how the system can be adapted to an existing roof curb nor how to replace an existing multizone rooftop unit. Moreover, installing two units of substantially different size and function can result in an awkward sized roof curb that could be difficult to adapt to the existing air ducts. Since a variable air volume cooling unit is typically much larger than a heating unit, in most cases it is likely that the existing roof curb would have to be replaced. Additional complications could also arise as mounting both units on top of one roof curb increases the weight concentration of the roof.

Therefore, it is an object of this invention to provide an assembly that adapts a single variable air volume cooling unit to an existing roof curb that was originally intended for a single multizone rooftop unit.

Another object is to provide an assembly that allows an inefficient combination heating/cooling multizone unit to be replaced by more efficient separate heating and cooling units using the existing air ducts.

Yet another object is to provide a multiple valve manifold assembly that regulates the flow of conditioned air from both the heating and cooling units and directs the regulated flow to the appropriate zones.

These and other objects of the invention will be apparent from the attached drawings and the description of the preferred embodiments which follow hereinbelow.

SUMMARY OF THE INVENTION

The retrofit assembly adapts two replacement air handling units to a building's existing roof curb and air ducts which were previously associated with one air handling unit serving multiple zones. The assembly includes a curb adaptor and a valve manifold. The curb adaptor is constructed of a rigid frame for supporting one of the replacement units on top of the existing roof curb and includes an air passage for conveying return air from the zones to an inlet in said one replacement unit. The other replacement unit is mounted on the roof beyond the perimeter of the existing roof curb. The valve manifold receives the air discharged from both replacement units and directs it into an existing plurality of supply air ducts which further convey the air to the plurality of zones in the building. The air passing through the manifold is regulated by a plurality of thermostatically controlled valves disposed therewithin.

DESCRIPTION OF THE PREFERRED EMBODIMENTS

Figure 1:
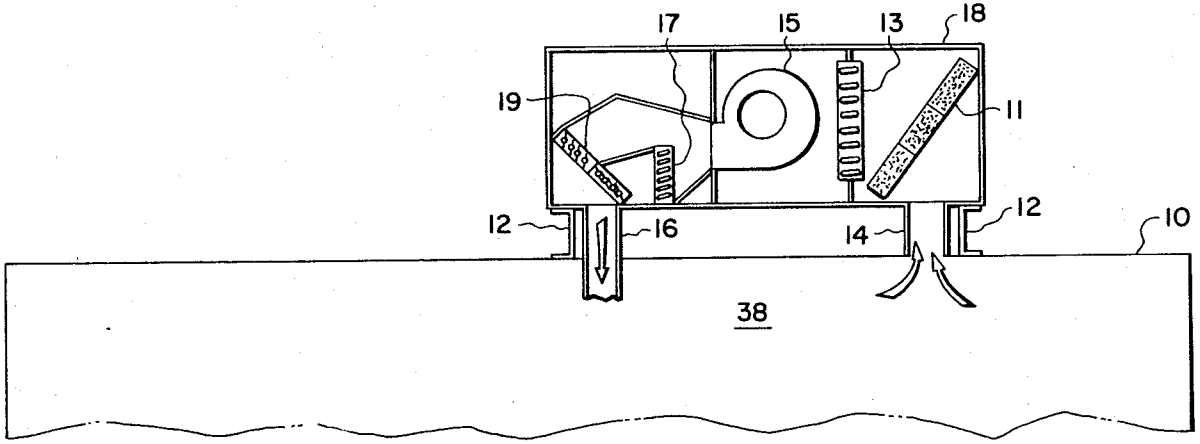
FIG. 1 shows a multizone rooftop air handling unit used for heating and cooling a plurality of zones.
Figure 2:
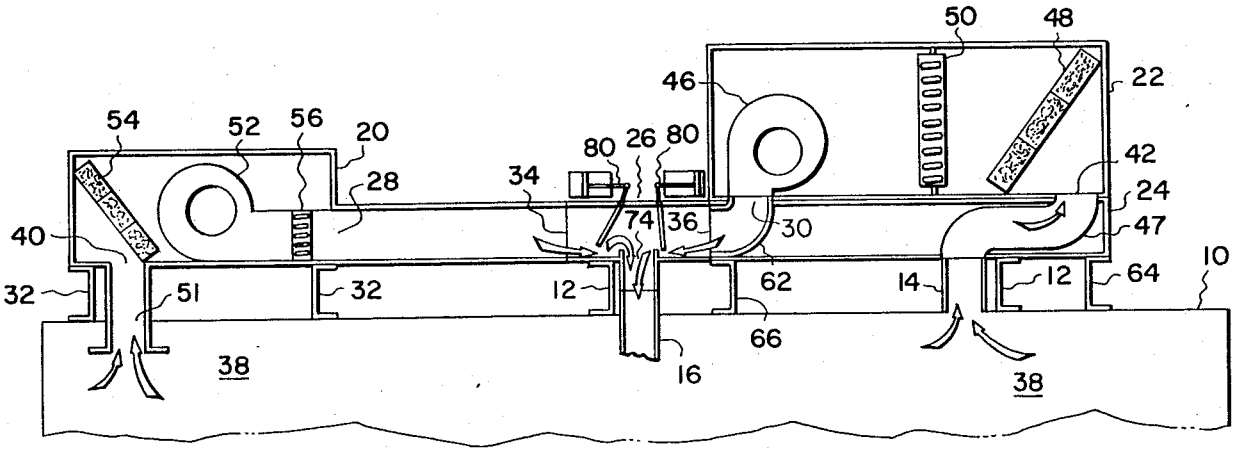
FIG. 2 illustrates how the curb adaptor and valve manifold is used to replace the air handling unit of FIG. 1 with two separate air handling units.

FIG. 1 shows a rooftop 10 with an existing roof curb 12, return air duct 14, and supply air ducts 16, all originally associated with a multizone rooftop unit 18. Multizone unit 18 is shown to include filter 11, cooling coil 13, blower 15, heating coil 17, and a plurality of thermostatically controlled dampers 19. FIG. 2 shows the same rooftop 10 after the multizone rooftop unit 18 has been replaced by a separate VAV (Variable Air Volume) heating unit 20 and a VAV cooling unit 22. FIG. 2 also shows the original roof curb 12, the original air ducts 14 and 16, a curb adaptor 24, and a valve manifold 26 which connects discharge outlets 28 and 30, of the two replacement units 20 and 22 to the existing supply air ducts 16.

The procedure for retrofitting the two separate units 20 and 22 includes removing the old multizone unit 18 and installing valve manifold 26 and curb adaptor 24 on top of the existing roof curb 12. The VAV cooling unit 22 is then mounted on top of curb adaptor 24. Heating unit 20 and its own separate roof curb 32 is also installed on rooftop 10. The discharge outlet 28 of heating unit 20 and the discharge outlet 30 of cooling unit 22 are both in fluid communication with valve manifold 26 at its heating and cooling inlets 34 and 36 respectively.

Return air from the building's temperature conditioned zones (not shown) passes through the building's return air duct network (not shown) and enters return air plenum 38. A VAV blower 46 draws air from plenum 38, up through a return air passage 47 which extends through curb adaptor 24, and in through inlet 42 of cooling unit 22. Blower 46 continues to draw the air through a filter 48, through a cooling coil 50, and discharges cooled air to cooling inlets 36 of manifold 26. Manifold 26 regulates and distributes the air flow through the building's plurality of supply air ducts 16 and on to the zones that need cooling.

Similarly, air to be heated is drawn from return air plenum 38, through a roof opening 51 made during the retrofit installation, and into heating unit 20 by a variable speed blower 52. After passing through filter 54 and being heated by a heating coil 56 that is associated with a burner or other suitable heat source (not shown), the heated air is discharged to heating inlet 34 of manifold 26 and is then regulated and distributed to the appropriate zones through the building's existing supply air ducts 16.

Figure 3:
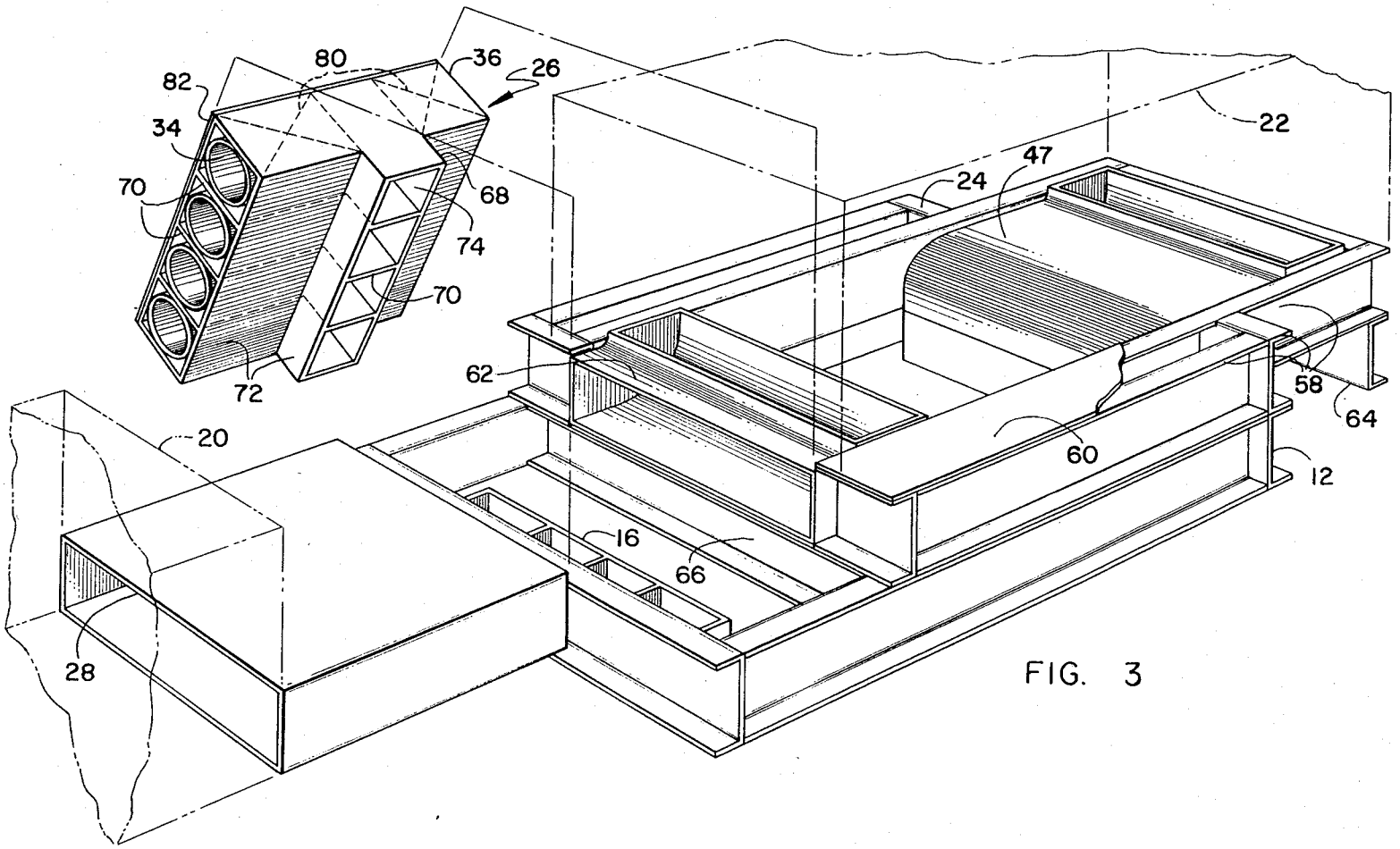
FIG. 3 is a perspective view of the curb adaptor and valve manifold.

Use of separate heating and cooling units 20 and 22 to provide this air handling and temperature conditioning function while using existing duct work 14 and 16 originally installed for a single unit 18 is made possible by curb adaptor 24 and valve manifold 26. Referring to FIG. 3, curb adaptor 24 includes a framework of C-channels 58. The underside of adaptor 24 has a profile adapted to fit on top of the existing roof curb 12, while the top of adaptor 24 fits the underside of cooling unit 22. This allows adaptor 24 to support cooling unit 22 atop roof curb 12. Any gaps due to an improper match between the bottom of cooling unit 22 and the top of roof curb 12 are covered with sheet metal 60 to shelter the interior of roof curb 12 from weather. Inlet air passage 47 is included in adaptor 24 to convey air from plenum 38 to inlet 42 of cooling unit 22. An outlet air passage 62 is also included in adaptor 24 for conveying air discharged from cooling unit 22 to cooling inlet 36 of valve manifold 26.

It should be appreciated that curb adaptor 24 can have a variety of shapes to conform to the wide variety of existing roof curbs and VAV cooling units. The location and size of air passages 47 extending through curb adaptor 24 can also vary to match the location and size of various existing air ducts. In addition, it should also be noted that supplemental curb sections 64 and 66 of FIGS. 2 and 3 can be added for additional support of any overhanging or otherwise unsupported portions of cooling unit 22.

Also mounted on top of the existing roof curb 12 and alongside curb adaptor 24 is manifold 26. Manifold 26 has a sheet metal outer shell 68 and includes several internal dividing panels 70 that define a plurality of T-shaped valve modules 72 in side-by-side relationship within manifold 26. The dividing panels 70 function to prevent air in adjacent modules 72 from mixing. Each module 72 includes one outlet 74 in fluid communication with its own heating and cooling inlets 34 and 36 respectively. A valve 80 is disposed in each inlet 34 and 36, and access to them for maintenance purposes, is by means of a removable top cover 82 fastened to manifold 26.

Manifold 26 has its heating inlets 34 connected in fluid communication with a discharge outlet 28 of heating unit 20 and its cooling inlets 36 connected in fluid communication with discharge outlet 30 of cooling unit 22. The discharge of both units 20 and 22 is directed by manifold 26 through a plurality of outlets 74 which are connected to the existing supply air ducts 16 that are associated with the plurality of zones.

Both valves 80 of each module are pneumatically (or electrically) operated and are controlled by a thermostat (not shown) disposed in their corresponding comfort zone. Heating valve 80 is controlled to open as its zone thermostat demands heat, and cooling valve 80 opens as its thermostat demands cooling. Valves 80 are schematically represented in FIGS. 2 through 8. For greater detail of an exemplary valve 80, reference should be made to U.S. Pat. No. 4,177,970, specifically incorporated by reference herein. It should be noted, however, that a variety of other alternative valves or dampers could also be used to serve the same function.

Figure 4:
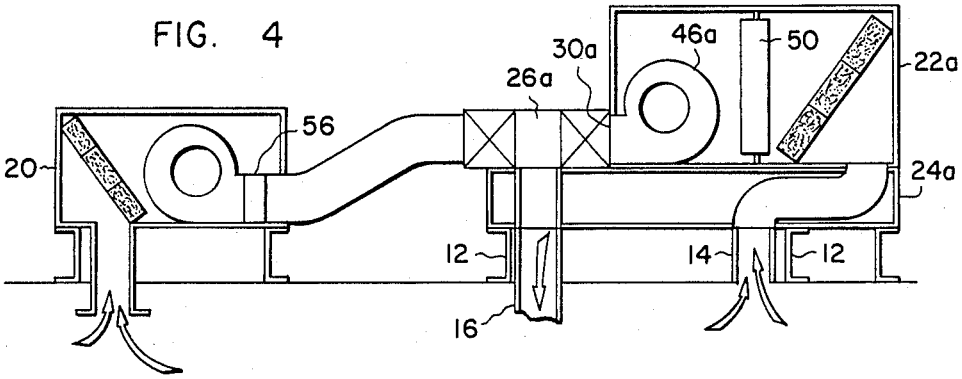
FIG. 4 illustrates how the valve manifold rests atop the curb adaptor when the cooling unit has a side discharge.

FIG. 4 shows a second embodiment of the invention wherein a VAV cooling unit 22a discharges cooled air out through its side rather than out the bottom. Valve manifold **26*a*, in such a discharge configuration, is elevated to the height of discharge outlet 30*a* and rests atop curb adaptor 24a which extends over the full length of roof curb 12. Cooled air discharged from blower 46*a* is first directed through manifold 26*a* before passing through curb adaptor 24*a*** and out to the zones that demand cooling.

Figure 5:
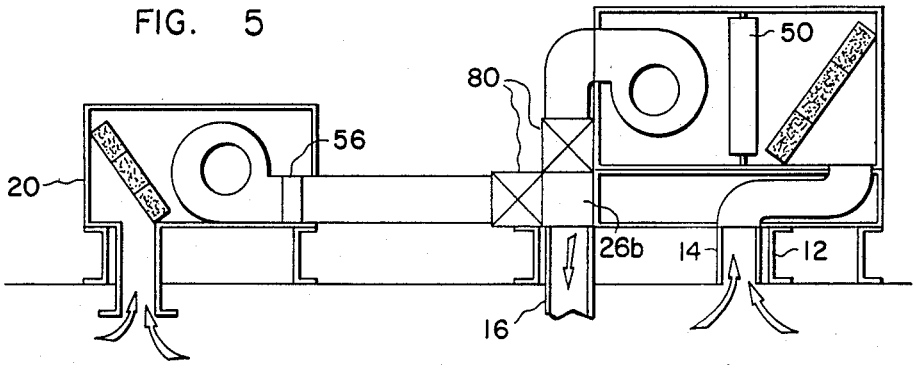
FIG. 5 shows a valve manifold having an L-configuration versus a T-configuration.

In a third embodiment, shown in FIG. 5, manifold **26*b* is in an L-configuration versus a T-configuration. Manifold 26*b* rests directly on the existing roof curb 12, while the operation of valves 80** remain essentially the same as the other embodiments.

Figure 6:
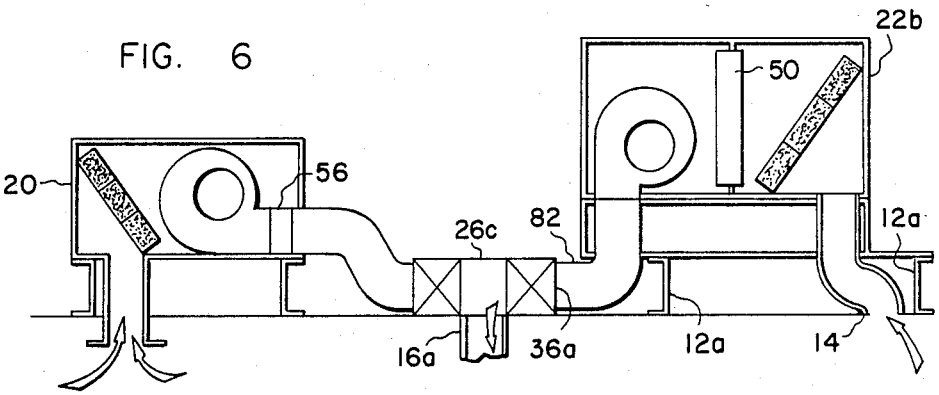
FIG. 6 shows an installation with the existing supply air ducts located beyond the perimeter of the existing roof curb.

FIG. 6 illustrates a fourth embodiment wherein the invention is adapted to an original installation having supply air ducts **16*a* located beyond the perimeter of the existing roof curb 12*a*. In retrofitting this type of installation, additional duct work 82 is installed to convey the cooled discharged air from cooling unit 22*b* to inlet 36*a* of valve manifold 26*c***.

Figure 7:
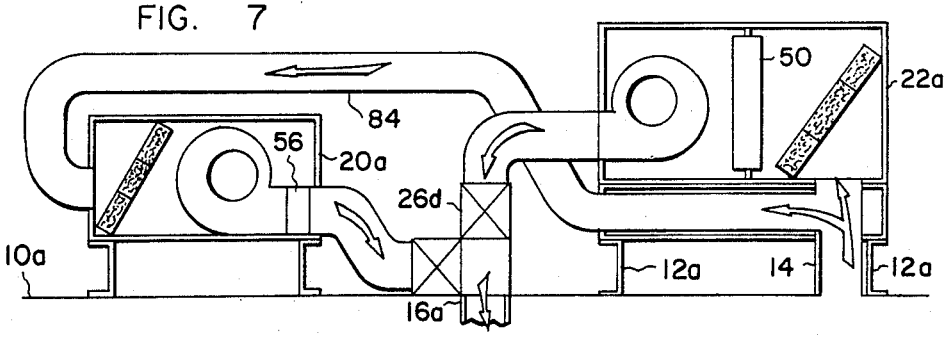
FIG. 7 shows a return air duct connecting the heating unit inlet to the air passage in the curb adaptor.

FIG. 7 shows a fifth embodiment wherein the original supply air ducts **16*a* are beyond the perimeter of the existing roof curb 12*a*, cooling unit 22*a* discharges air out through its side, a return air duct 84 for heating unit 20***a* is installed above roof 10*a*, and manifold 26*d* is in an L-configuration.

Although this invention is described with repect to several embodiments, modifications thereto will become apparent to those skilled in the art. Therefore, the scope of this invention is to be determined by reference to the claims which follow.

We claim:

1. An assembly for retrofitting two replacement air handling units to a building's existing roof curb, existing supply air ducts, and existing return air duct which were associated with a previous air handling unit serving multiple zones, said assembly comprising:

a. an adaptor frame of generally rectangular shape, including means for supporting one of the replacement air handling units atop the existing roof curb and further including a return air passage for conveying return air from the existing return air duct to a return air inlet in said one of the replacement air handling units;

b. means for supporting the other replacement air handling unit adjacent the adaptor frame and including means for conveying return air from the building into a return air inlet of the other replacement air handling unit; and c. manifold means for connecting a discharge outlet of each of the two replacement air handling units to the existing supply air ducts in the building and including a plurality of valves for controlling the flow of discharge air from each replacement air handling unit into the supply air duct for each zone in the building.

2. The assembly as recited in claim 1, wherein at least one of the zones being served is associated with two of the plurality of valves, with one of the two valves used for modulating air discharged from one of the replacement air handling units and with the other valve used for modulating air discharged from the other air handling unit.

3. The assmbly as recited in claim 1, wherein a thermostat disposed in one of the zones controls the operation of at least one of the valves.

4. The assembly as recited in claim 1, wherein at least one of the valves is located on top of the existing roof curb.

5. The assembly as recited in claim 1, wherein said manifold means includes a removable cover for providing access to said plurality of valves.

6. The assembly as recited in claim 1, wherein the plurality of valves are disposed beyond the perimeter of the adaptor frame.

7. The assembly as recited in claim 1, wherein the return air inlet of said other air handling unit is in fluid communication with an opening in the roof that extends down to a return air plenum.

8. The assembly as recited in claim 1, wherein the return air inlet of said other replacement air handling unit is in fluid communication with the return air of the building by means of another return air duct having one end connected to the inlet of said other replacement air handling unit and another end connected to the return air passage in said adaptor frame.

9. The assembly as recited in claim 1, wherein the two replacement air handling units include a heating unit and a cooling unit.

10. The assembly as recited in claim 1, wherein at least one of the replacement air handling units includes a blower having a variable air volume discharge.

11. The assembly as recited in claim 1, further comprising supplemental curb sections disposed under the adaptor frame for providing additional support of said one replacement air handling unit.

12. An assembly for retrofitting two replacement air handling units to a building's existing roof curb and air ducts which were associated with a previous air handling unit serving multiple zones, said assembly comprising:

a. a curb adaptor interposed between the existing roof curb and one of the replacement air handling units for supporting said one of the replacement units atop the existing roof curb, said adaptor including a rigid frame having a bottom profile conformed to fit on top of the existing roof curb and having a top profile conformed to fit the underside of said one replacement unit, said adaptor further including a return air passage that places an existing return air duct in the building in fluid communication with an inlet in said one replacement unit;

b. a manifold having a plurality of supply air passages for directing conditioned air discharged from both replacement air handling units into a plurality of existing supply air ducts which in turn convey the conditioned air to a plurality of zones in the building; and c. a plurality of thermostatically controlled valves disposed in the manifold's plurality of supply air passages for modulating air flow therethrough.

13. The assembly as recited in claim 12, wherein at least one of the zones served is associated with two of the plurality of valves, with one of the two valves used for modulating air discharged from one of the replacement air handling units and with the other valve used for modulating air discharged from the other air handling unit.

14. The assembly as recited in claim 12, wherein a thermostat disposed in one of the zones controls the operation of at least one of the valves.

15. The assembly as recited in claim 12, wherein at least one of the valves is located on top of the existing roof curb.

16. The assembly as recited in claim 12, wherein said manifold includes a removable cover for providing access to the plurality of valves.

17. The assembly as recited in claim 12, wherein the plurality of valves are disposed beyond the perimeter of the curb adaptor.

18. The assembly as recited in claim 12, wherein a return air plenum, located beneath the roof of the building, is in fluid communication with the inlet of the said other replacement air handling unit through an opening in the roof.

19. The assembly as recited in claim 12, further comprising another return air duct that places the inlets of both replacement air handling units in fluid communication with each other.

20. The assembly as recited in claim 12, wherein the two replacement air handling units include one heating unit and one cooling unit.

21. The assembly as recited in claim 12, wherein at least one of the replacement air handling units includes a blower having a variable air volume discharge.

22. The assembly as recited in claim 12, further comprising a supplemental curb section disposed under the curb adaptor for providing additional support of said one replacement air handling unit.

23. An assembly for retrofitting two separate replacement air handling units, one for heating and the other for cooling, to a building's existing roof curb and air ducts which were previously associated with a combination heating and cooling unit serving multiple zones, said assembly comprising:

a. a curb adaptor interposed between the existing roof curb and one of the replacement air handling units for supporting said one of the replacement units atop the existing roof curb, said adaptor including a rigid frame having a bottom profile conformed to fit on top of the existing roof curb and having a top profile conformed to fit to the underside of said one replacement unit, said adaptor further including a return air passage that places an existing return air duct in the building in communication with an inlet of said one replacement unit;

b. a separate roof curb, spaced apart from said existing roof curb for supporting the other replacement air handling unit;

c. a manifold having a plurality of supply air passages for directing conditioned air discharged from both replacement air handling units into a plurality of existing supply air ducts which in turn convey the conditioned air to a plurality of zones in the building; and d. a plurality of thermostatically controlled valves disposed in the manifold's plurality of supply air passages, wherein at least one of the zones served is associated with two of the plurality of valves, with one of the two valves used for modulating air discharged from the heating unit and with the other valve used for modulating air discharged from the cooling unit.

24. The assembly as recited in claim 23, wherein at least one the valves is located on top of a portion of the existing roof curb.

25. The assembly as recited in claim 23, wherein said manifold includes a removable cover for providing access to the plurality of valves.

26. The assembly as recited in claim 23, wherein the plurality of valves are disposed beyond the perimeter of the curb adaptor.

27. The assembly as recited in claim 23, wherein a return air plenum, located beneath the roof of the building, is in fluid communication with the existing return air duct and is also in fluid communication with the inlet of said other replacement air handling unit through an opening in the roof.

28. The assembly as recited in claim 23, further comprising another return air duct that places the inlets of both replacement air handling units in fluid communication with each other.

29. The assembly as recited in claim 23, wherein the cooling unit includes a blower having variable air volume discharge.

30. The assembly as recited in claim 23 further comprising a supplemental curb section disposed under the curb adaptor for providing additional support of said one replacement air handling unit.

* * * * *